United States Patent [19]

Houchen et al.

[11] 3,961,626

[45] June 8, 1976

[54] HYPERBARIC AND UNDERWATER EXTRATHORASIC ASSISTED BREATHING METHOD AND APPARATUS

[76] Inventors: John R. Houchen, 9175 Southern Road, La Mesa, Calif. 92041; Irving Rehman, 5153 Tampa Ave., Tarzana, Calif. 91356

[22] Filed: Apr. 18, 1975

[21] Appl. No.: 569,524

[52] U.S. Cl. ..... 128/145 R; 128/30.2

[51] Int. Cl.[2] ..... A62B 7/00

[58] Field of Search ..... 128/30.2, 30, 28, 33, 128/38, 39, 145.5, 145.6, 145.8, 142.2, 142.3, 142, DIG. 17, 208, DIG. 29, 204

[56] References Cited

UNITED STATES PATENTS

| | | | |
|---|---|---|---|
| 3,033,195 | 5/1962 | Gilroy et al. | 128/145.8 |
| 3,078,842 | 2/1963 | Gray | 128/30.2 |
| 3,333,581 | 8/1967 | Robinson et al. | 128/30.2 |
| 3,537,450 | 11/1970 | Fox | 128/145.6 |
| 3,683,655 | 8/1972 | White et al. | 128/30.2 |
| 3,905,362 | 9/1975 | Eyrick et al. | 128/145.8 |

*Primary Examiner*—Robert W. Michell
*Assistant Examiner*—Henry J. Recla
*Attorney, Agent, or Firm*—Richard S. Sciascia; Ervin F. Johnston; Thomas Glenn Keough

[57] ABSTRACT

An assist for divers breathing a dense gas mixture reduces the fatigue otherwise caused by inspiring and expiring the dense mixture. A respiratory assist cuirasse is fitted to cover the upper abdomen and lower rib cage. The cuirasse has an outer semirigid shell and a flexible bladder inside connected to a pump module which creates positive and negative pressures inside of the covered area to assist normal breathing. A control module and sensors respond to humidity, temperature, or pressure variations in the breathing mixture and breathing apparatus to actuate the pump module. While normal breathing is being facilitated and augmented, there is a greater pulmonary flow and resultant increase in the oxygenation of the blood due to the negative pressure created by the respirator assist cuirasse. As a consequence, a diver will be able to more efficiently perform the demanding tasks during periods of heavy exertion in the cold water.

48 Claims, 19 Drawing Figures

HYPERBARIC AND UNDERWATER EXTRATHORASIC ASSISTED BREATHING METHOD AND APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Diving, by itself, can be a strenuous activity. When the moving of equipment or other heavy work is to be performed, a diver often labors just short of fatigue. Now that saturation diving and related techniques permit diving operations to be performed at extreme depths, dense, sophisticated breathing mixtures have thrust another load upon the diver. The increased masses and viscosities of these mixtures require considerable energy for inspiration and expiration. While at the surface, the effort exerted for breathing is small and is generally taken for granted, but at great depths this effort is of such a magnitude as to seriously impair a diver's ability to function effectively. It has been shown by research and diving tests, that the work of diving increases with an increase in the density of the diving mixture. The gaseous exchange between the tracheobronchial tree alveoli and the vasculature decreases under increased work load due to the respiratory efforts increasing. That is, with the depth of respiration decreasing, an increase in dead space occurs within the trachea and bronchi, and respiratory fatigue sets in due to inadequate $O_2CO_2$ exchange occurring. The respiration becomes more rapid but shallower and, therefore, a cycle of decreased gaseous exchange occurs. Muscle fatigue then sets in rapidly and the work load is decreased.

In one example of a simple test that produced fatigue, two divers were placed in a hyperbaric test chamber which was pressurized to a simulated depth of around 600 feet. Although simple tasks were to be performed the divers soon became fatigued. Tightening a nut on an overhead bolt left them gasping and they had to rest twice before the bolt was tightened. The great effort expended to breathe the dense gas mixture, coupled with the work of raising the arms and hands overhead to tighten the nut were incapacitating. Obviously, their job effectiveness was marginal, largely due to the breathing effort.

One attempt to reduce the effort imposed by breathing the dense gas mixture calls for forcing the mixture into the diver's lungs. A suitable sensing device, similar to a demand regulator diaphragm senses the beginning of the normal inhalation of gas. The sensor would then trigger a pump, which would force more of the mixture into the lungs. Usually, this initiates a strangling or gagging response and it is up to the diver to exhale unassisted. Any diver who has used such a system will attest that it is manifestly uncomforable and psychologically disturbing. From the physiological standpoint, experiments have shown that there is an interference with the intrapulmonary pressure within the pleural cavity. The interference is actually in the form of an increase in the intrapulmonary pressure which directly depresses the blood flow. It has been observed that when using this forced gas technique and applying a suitable ventilatory pressure to double the tidal volume of the gas mixture in the lungs, the blood flow was depressed as much as 14 percent. Thus, the cardiac output is reduced, the pulmonary artery resistance increased, and the dynamics of the chest are altered significantly.

To reemphasize, the forced gas method or iatrogenic type of respiration is abnormal for it is directly opposite to the normal respiratory rhythm. The breathing mixture is forced to the tracheo-bronchial tree under positive pressure to insufflate the lungs, aveolar sacs, etc. The diaphragm is pushed downward by the forced gas rather than the diaphragm's drawing in the breathing mixture. A consequence of this pressing of the air into the respiratory tract under pressure is that intrapulmonary pressure within the cavity is increased. The heart is partially collapsed, the cardiac output is depressed and the culminary artery resistance is increased. As a result, blood flow is reduced. This result is unacceptable particularly for a diver who must work to his limits. There is a continuing need in the state-of-the-art for a diver aid which eases the burden imposed by dense breathing gas mixtures and yet does not adversely psychologically or physiologically affect its user.

Summary of the Invention

The present invention is directed to providing a method of and an apparatus for assisting the breathing of a diver. A cuirasse made up of a semi-rigid outer shell containing a flexible bladder is fitted over the upper abdomen and lower rib cage. Means are carried in the diver's underwater breathing system for sensing normal inhalation and exhalation to provide representative signals thereof. A source of fluid, be it either gas or liquid, is made available. A means is coupled to the flexible bladder, the sensing means and the fluid source for pumping fluid into the flexible bladder to create a positive pressure therein when the sensing means transmits and exhalation signal and for pumping fluid out of the flexible bladder to create a negative pressure therein when the sensing means transmits an inhalation signal. The aforeidentified apparatus ensures a method to assist the breathing of the diver when there is a placing of the respiratory cuirasse on the upper abdomen or rib cage. The sensing of the normal inhalation of gas by the diver causes the evacuation of fluid from the respiratory cuirasse. Consequently, there is a drawing of the diaphragm downwardly by the evacuated fluid to provide an assist to inhalation. When there is a sensing of the normal exhalation of gas, fluid is flooded into the respiratory cuirasse and the diaphragm is forced upward by the flooded fluid to provide an assisted exhalation.

It is a prime object of the invention to provide an apparatus for assisting the normal breathing of a diver.

Another object of the invention is to provide an apparatus worn by a diver about his upper abdomen and lower rib cage which exerts positive and negative pressures to assist normal breathing.

Yet another object is to provide an apparatus which senses normal inhalation and exhalation to assist normal breathing.

Still another object is to provide an apparatus, which while assisting normal breathing also increases the pulmonary flow.

Still another object is to provide a diver-carried apparatus which transfers a flow of fluid to assist normal breathing.

Another object is to provide an apparatus for assisting a diver's normal breathing which is lightweight and has a relatively low power consumption.

Another object is to provide an apparatus which assists a diver's normal breathing and which is not overly bulky or cumbersome.

Another object is to provide a relatively uncomplicated device for assisting a diver's normal breathing, which inherently possesses a high degree of reliability.

Another object is to provide an apparatus which optionally draws fluid from a contained source or from the ambient seawater, to assist normal breathing.

Another object is to provide an apparatus which has the capability for changing the magnitude and rate of positive and negative pressures to accommodate changing diver's demands.

Another object is to provide a method for assisting the normal breathing of a diver.

Another object is to provide a method of assisting normal breathing by having an apparatus worn by a diver about his upper adbomen and lower rib cage which exerts positive and negative pressures.

Another object is to provide a method which calls for the sensing of normal inhalation and exhalation to assist normal breathing.

Still another object is to provide a method which while assisting normal breathing also increases the pulmonary flow.

Still another object is to provide a method which transfers a flow of fluid to assist normal breathing.

Another object is to provide a method for assisting a diver's normal breathing which is lightweight and has a relatively low power consumption.

Yet another object is to provide a method which assists a diver's normal breathing and which is not overly bulky or cumbersome.

Yet another object is to provide a method for assisting a diver's normal breathing, which inherently possesses a high degree of reliability.

Yet another object is to provide a method which optionally draws fluid from a contained source or from the ambient seawater, to assist normal breathing.

Yet another object is to provide a method for changing the magnitude and rate of positive and negative pressures to accommodate changing diver's demands.

These and other objects of the invention will become more readily apparent from the specification when taken with the drawings.

DESCRIPTION OF THE PREFERRED EMBODIMENT

Figure 2:
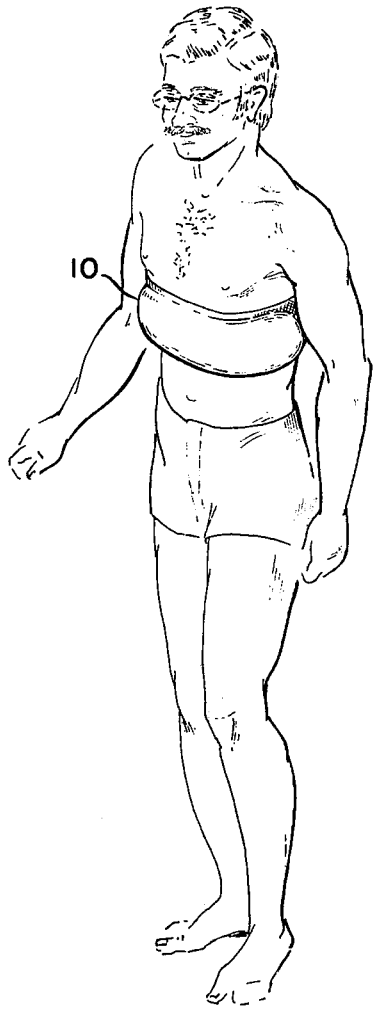
FIG. 2 shows an unsuited diver wearing a respiratory cuirasse.
Figure 4:
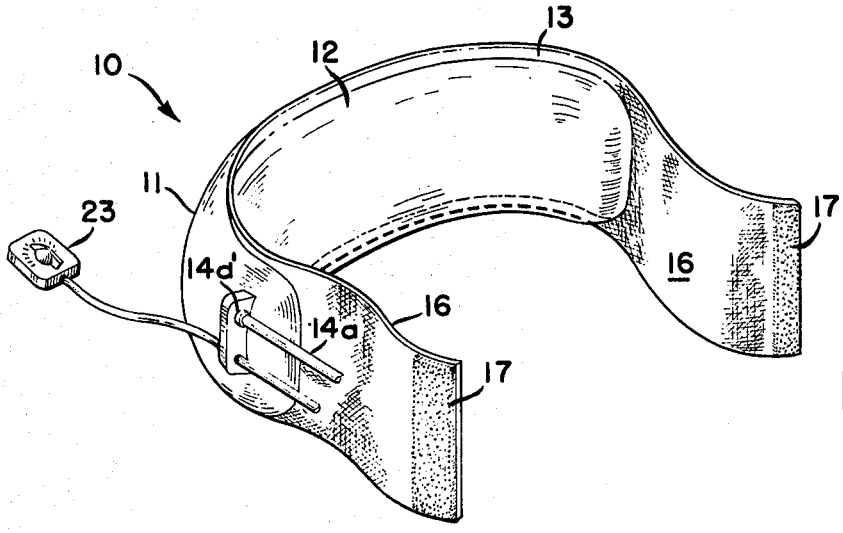
FIG. 4 is a rear view of the respiratory cuirasse.
Figure 5:
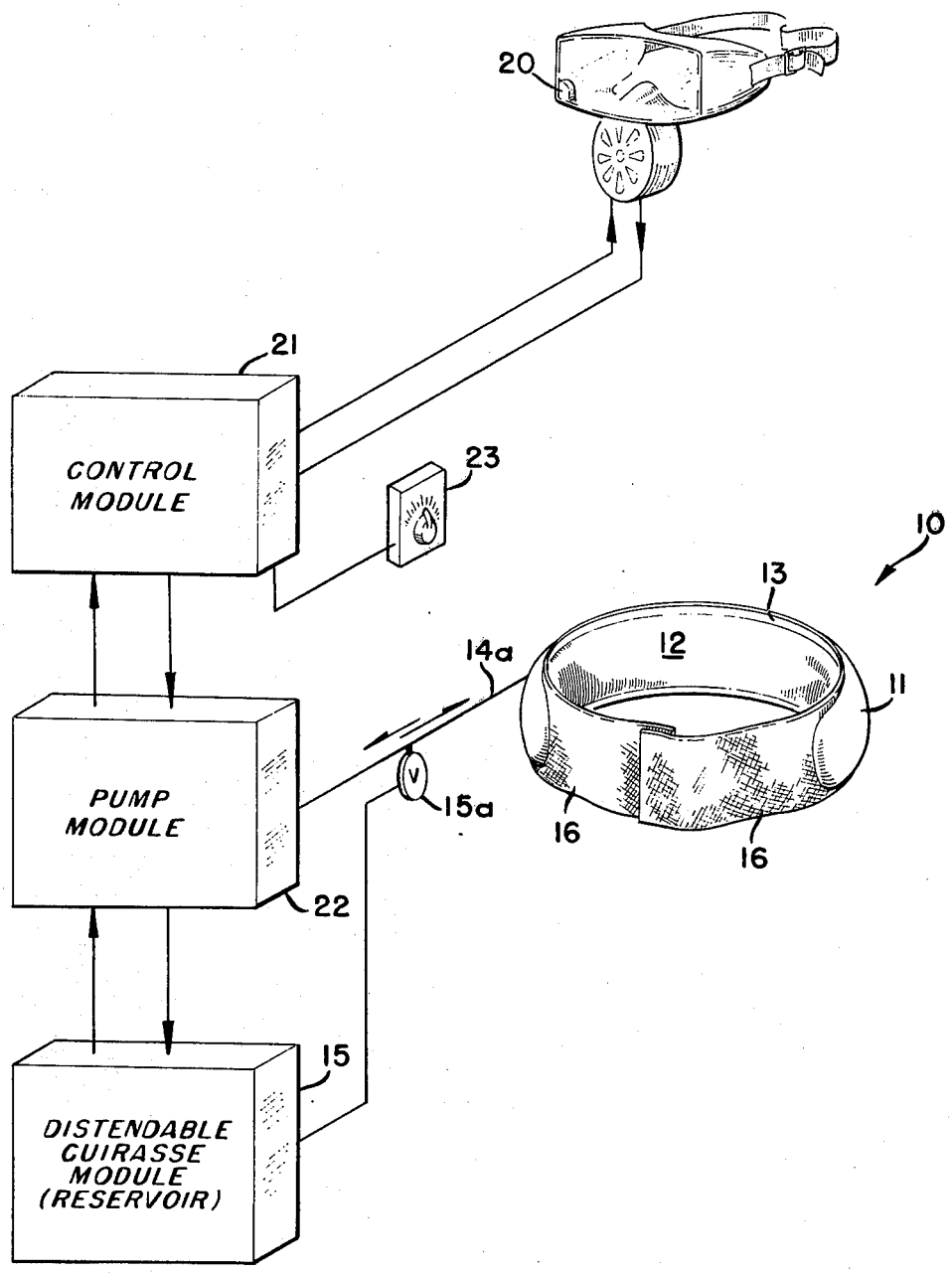
FIG. 5 is a schematic representation of the apparatus for assisting normal breathing.
Figure 6A:
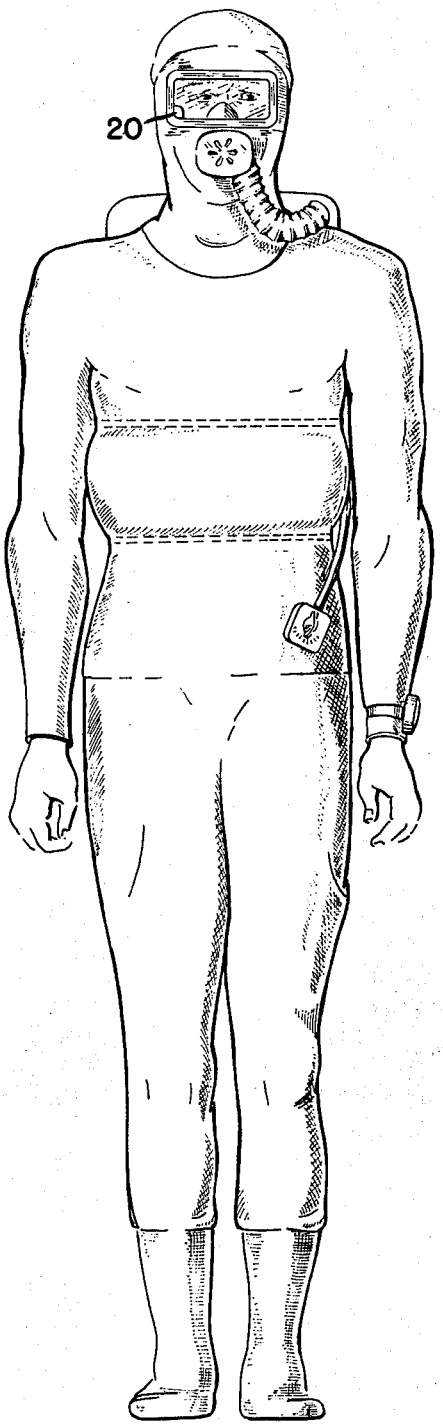
FIGS. 6*a* and 6*b* show a diver wearing the breathing system apparatus.
Figure 6B:
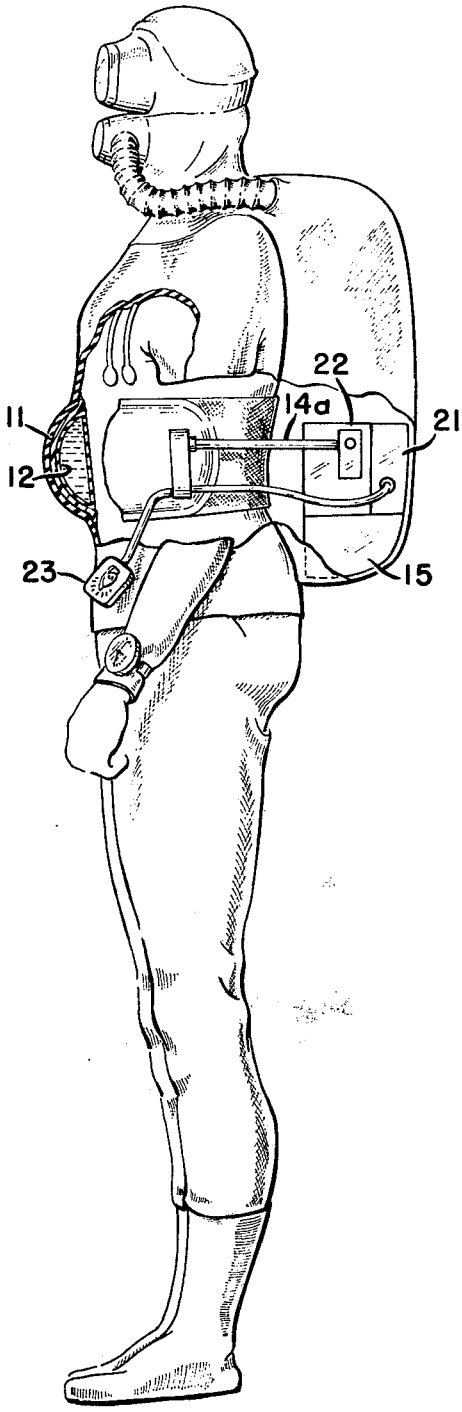

A cuirasse 10 serves to transfer the positive and negative pressures to the abdominal viscera. The cuirasse has an outer, semirigid shell 11, containing a flexible bladder 12. The shell is made from a tough plastic or lightweight metal alloy which resists deformation. It has an arc-shaped, cross-sectional configuration defining a hollow cavity which accommodates the area of the upper abdomen and the lower rib cage, see FIG. 2. To facilitate such a fitting it is provided with a lip 13 which circumscribes the area on which the cuirasse is fitted.

Figure 7:
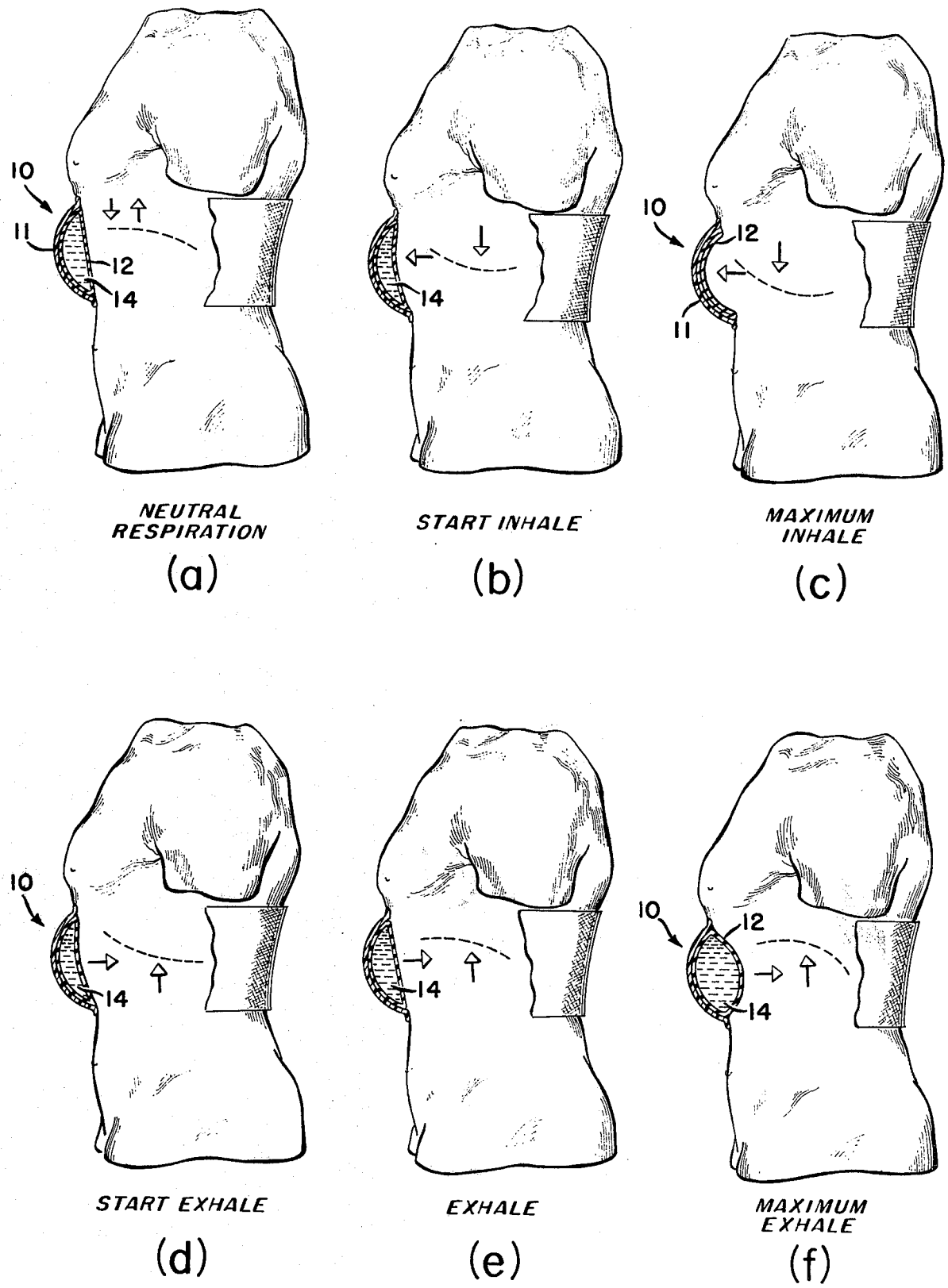
FIGS. 7*a* through 7*f* show exaggerated depictions of the operation of the cuirasse as it assists normal breathing.

The flexible bladder is rubber or an elastomer impregnated fabric which possesses a sufficient flexibility to be completely collapsed, see FIG. 7*c*, or sufficiently distended, see FIG. 7*f*, to ensure the assist to breathing. Such a collapse or distention occurs when a fluid 14 is evacuated from or pumped into the bladder via a hose 14*a* and an interconnected fitting 14*a'*.

It is the controlled collapse and distention of the flexible bladder in conjunction with the close fitting, semirigid shell which provides the assist to breathing, as will be elaborated on below. Close fitting of the shell and bladder are provided for by a couple of lengths of webbing 16 which are joined at their ends by velcro, snaps or tie fasteners 17. The webbing snugly holds lip 13 against the body either on the body or on a resilient wet-suit to seal the interior of the cuirasse from the surroundings.

With the shell and flexible bladder containing the upper abdomen and lower rib cage, and lip 13 being held in sealed relationship, assisted respiration can be induced. Pumping a fluid, be it a gas or liquid through hose 14*a* and fitting 14*a'* into flexible bladder 12 causes the distention of the bladder and the application of a positive pressure on the contained area of the body.

This positive pressure on the upper abdominal area is transmitted to the diaphragm, see FIG. 7*d*. Continued flooding distends the bladder further and more upward force is transmitted to the diaphragm, see FIG. 7*e*. When the flexible bladder is distended to a maximum degree, noting FIG. 7*f*, maximum upward force is exerted on the diaphragm marking the end of the exhalation cycle.

Similarly, inhalation is assisted by the cuirasse by the controlled evacuation of fluid 14 from the flexible bladder. Fluid begins to be drawn out of the bladder at the beginning of the inhalation cycle, see FIG. 7*a*. As more and more fluid is pumped out, the bladder begins to collapse toward the inner wall of the semirigid shell. This collapsing of the bladder creates a negative pressure to be exerted on the covered area, since lip 13 is sealed around it. The negative pressure acts on the upper abdominal area which, in turn, draws the diaphragm downward, see FIG. 7*b*. When all the fluid has been pumped from the flexible bladder so that it collapses against the inner wall of the semirigid shell, a maximum negative pressure or suction pulls at the upper abdominal area and the diaphragm is further drawn down, note FIG. 7*c*.

From the foregoing, it is apparent that a natural assist to breathing is feasible with the cuirasse. All that is needed are the sensors and controls which would synchronize the flooding and evacuation of the cuirasse with a diver's normal respiration.

A sensor 20 is included to provide a signal representative of normal inhalation and exhalation. The sensor optionally is any one of a variety of sensors which when appropriately connected by one skilled in the art, provide a signal representative of physical or physiological phenomena. Here, respiration is to be monitored so a sensor that measures a change of humidity of the breathing mixture is suitable. The sensor of temperature of the breathing mixture, a thermistor, could also have been chosen as well as the diaphragm in the diver's regulator. Sensors could even be placed on the diver's body to indicate the change of size of the abdominal thorasic cavity.

A humidity sensor 20 mounted in a face mask has been found to function satisfactorily to provide the representative signals. There are a variety of commercially available humidity sensors which have long been used in this regard and further discussion is dispensed with to avoid belaboring the obvious. One restriction that may rule out several large sensors and selection of the right one is that it must be small enough to fit inside a face mask without overly crowding the diver.

Figure 1:
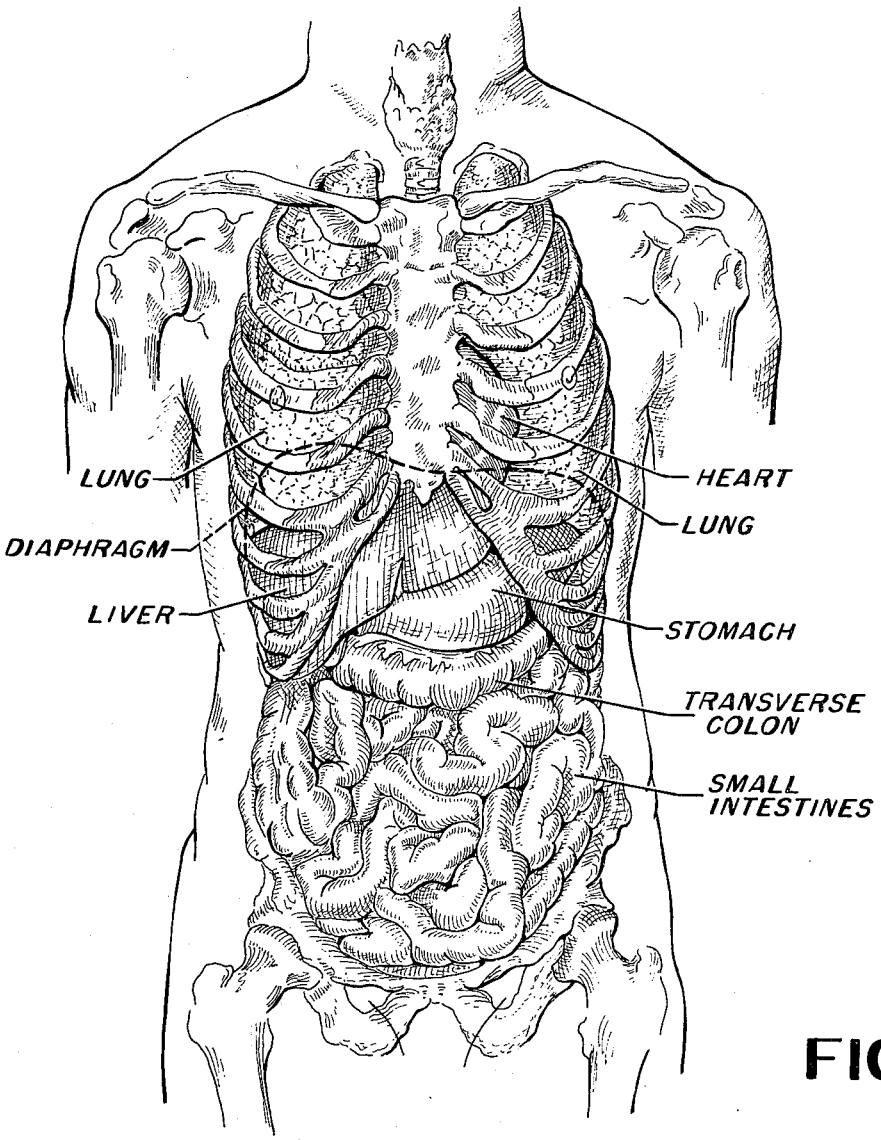
FIG. 1 depicts an anterior view of the abdominal and thoracic viscera.
Figure 8:
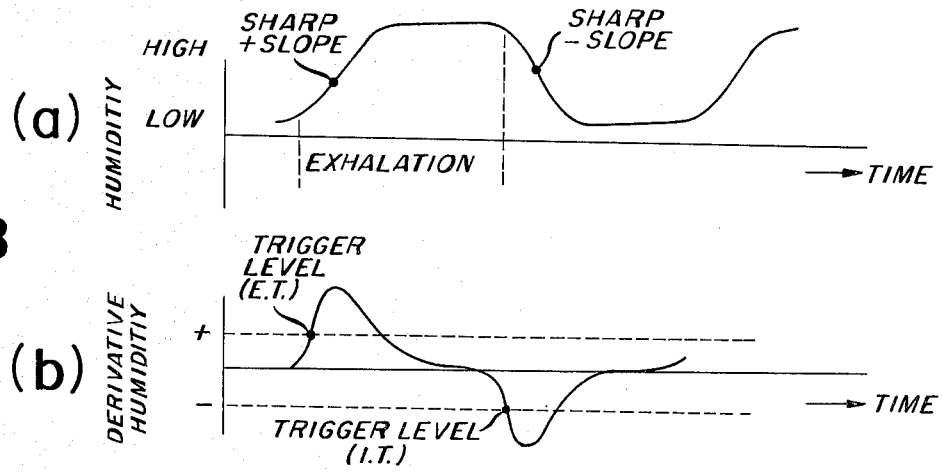
FIG. 8 is a graphic representation of the output signal of a humidity sensor.
Figure 3:
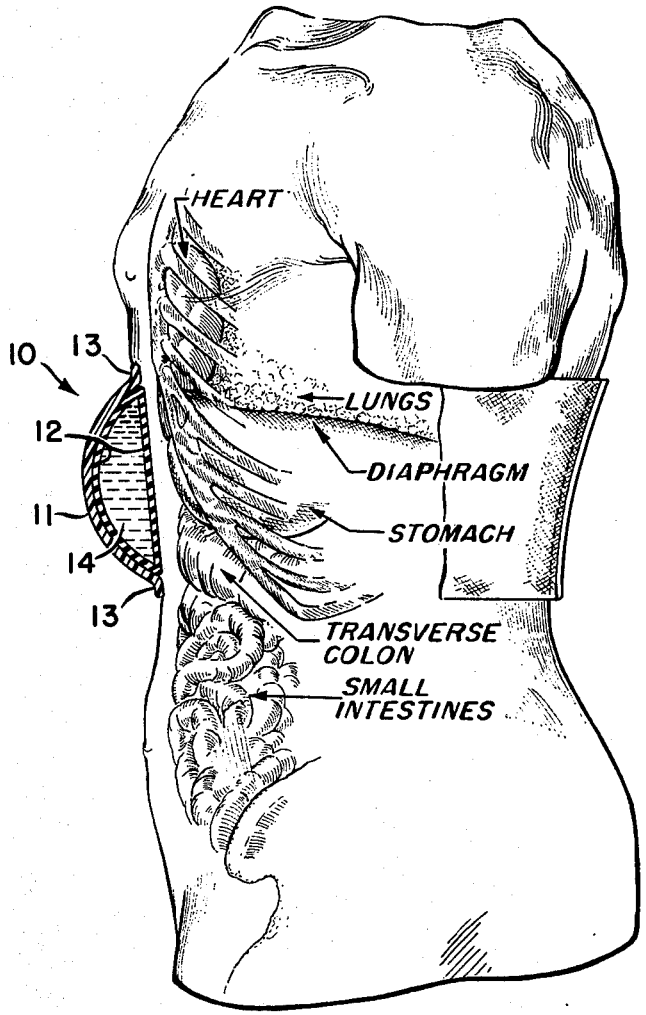
FIG. 3 is a side view showing the relationship of the cuirasse to the abdominal and thoracic viscera.

Since, normally, dry air is inhaled and vapor saturated air is exhaled, a single rapidly acting humidity sensor will detect the full cycle of respiratory activity. Looking to FIG. 8*a* a humidity sensor's typical analog response provides signals representative of normal exhalation and inhalation. By examination of this response, it is apparent that there may be an ambiguity in using this analog response alone to trigger a breathing assist. Low humidity can indicate inhalation or respiratory inactivity at some point after inhalation, while high humidity can indicate exhalation or respiratory inactivity after exhalation. This difficulty can be overcome by using the slope of humidity as the determinant of inhalation or exhalation. That is to say, a sharp positive slope generated by an increase in humidity and a sharp negative slope generated by a decreasing humidity become the indicators of exhalation and inhalation. FIG. 8*b* illustrates the derivative of humidity and a trigger point marked "ET" where an exhalation assist is to occur and a trigger point IT where an inhalation assist would be applied.

Although humidity sensing lends itself well to this particular application, other sensing techniques referred to above optionally are employed. Irrespective what means is chosen to derive the signals representative of normal inhalation and normal exhalation, these signals are fed to a control module 21.

The control module contains the necessary electromechanical and electronic devices to ensure that an interconnected pump module 22 pumps fluid 14 to and from flexible bladder 12 of cuirasse 16. In the various configurations set out in FIGS. 9 through 13 the exact elements forming the control module and the pump module are different. Usually the pump module is that prime mover of fluid 14 which directly effects the transfer of the fluid to and from the cuirasse. The control module is made up of the elements connected to and which drive the prime mover.

The last main constituant of the respiratory assist apparatus is a reservoir 15. The reservoir is coupled to the cuirasse by a valve 15*a* to transfer greater or lesser amounts of fluid 14 and thereby acts as an auxiliary control of the maximum and minimum pressures exerted by the cuirasse. The reservoir provides a working fluid 15*b* to the control and pump modules and it is carried conveniently in the diver's back pack. The capacity of the reservoir is limited by the volume of the fluid in the cuirasse and by the amount of working fluid needed to initiate the respiration assist.

The fluid optionally is compressed gas supplied by scuba type tanks or an umbilical cord from an undersea habitat. When the fluid chosen is a liquid it can be a relatively inert liquid so as not to corrode the apparatus or, for the sake of convenience, ambient seawater may be selected.

The device for controlling the magnitude and flow rate of the working fluid is schematically shown as manual control 23. The elements which perform this function vary in the several embodiments to be discussed. As mentioned above, valve 15*a* works in conjunction with the manual control and is opened to further fill the cuirasse when deeper breaths are needed or bleed some fluid back to the reservoir when shallower breathing is called for.

The power requirements for this apparatus are modest enough to allow the carrying of a battery pack in the diver's back pack. It has been demonstrated that a 0.1 Hp is adequate to pump the fluid and a portable battery can drive this motor for a considerable period of time.

Figure 9:
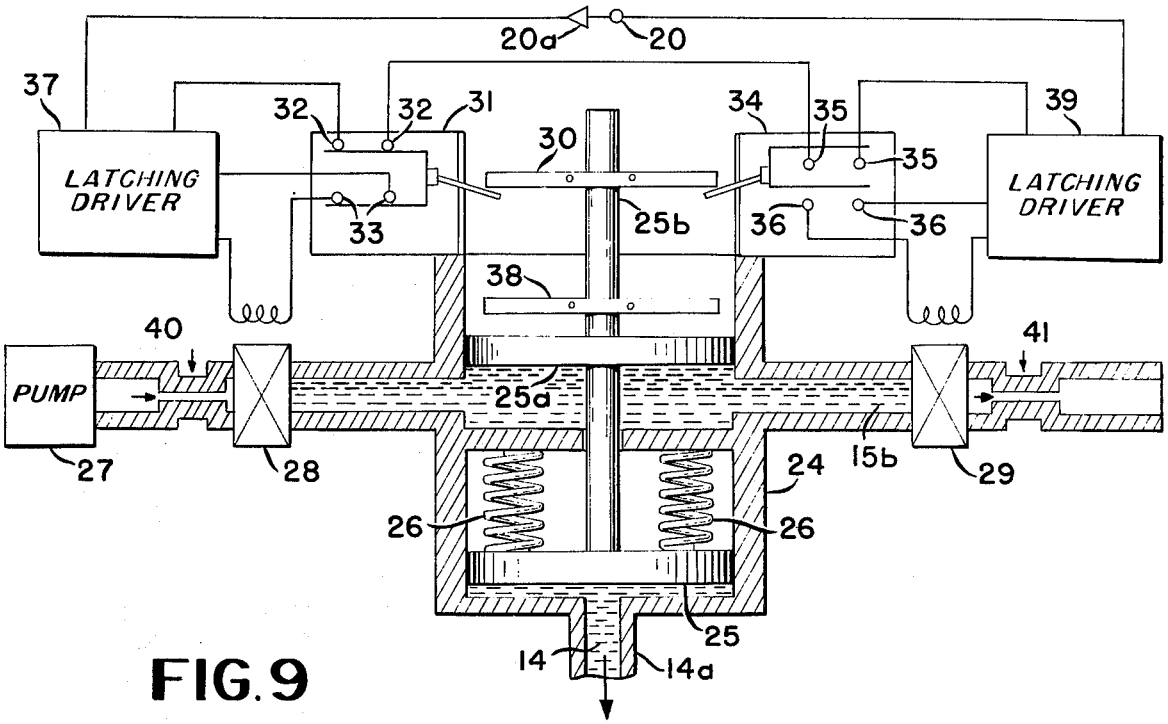
FIGS. 9 through 13 show representative embodiments of the control module and pump module.

A representative control module and pump module for distending and collapsing the cuirasse is depicted in schematic form in FIG. 9.

A cylindrically shaped housing 24 contains a first piston 25 urged toward a forward position by a pair of biasing springs 26.

A driver piston 25*a* is mounted about halfway down a common shaft 25*b* and has nearly the same dimensions as the first piston. A pair of solenoid actuated valves 28 and 29 normally isolate the housing interior unless they are properly actuated by an inhalation signal or an exhalation signal.

When valve 28 is opened, working fluid 15*b* from either reservoir 15 or the surrounding seawater is pumped into the housing by a pump 27. The pressure acting on the face of driver piston 25*a* overcomes the force exerted by biasing springs 26 on piston 25 and it is drawn toward a rear position.

On the other hand, when solenoid actuated valve 29 is opened, any working fluid 15*b* trapped in the housing is allowed to drain to the reservoir or the surroundings. The biasing force of springs 26 return piston 25 to the forward position.

During the reciprocal excursions of piston 25, fluid 14 is pumped into the cuirasse to aid breathing. How synchronization of the pumping mechanism to assist normal breathing is accomplished is best understood from the following description of operation.

An inhalation signal from sensor 20 is fed to latching driver 37 and it closes. This feeds a signal which opens solenoid valve 28 and working fluid 15*b* from motor pump 27 rushes to the inside of housing 24. The pressure on driver piston 25*a* pulls piston 25 to the rearward position and fluid 14 is drawn out of the flexible bladder 12. A negative pressure in the cuirasse is created which assists the diver's inhalation. The inhalation assist might continue until the flexible bladder is entirely evacuated of fluid, see FIG. 7*c*.

At this time, a stop 38 mounted on an extension of the piston shaft 25*b* contacts toggle switch 31 to break open contacts 32 and 33. Solenoid valve 28 is closed to inhibit a greater inhalation assist even if additional inhalation signals were received by latching driver 37.

Such signals would have no effect, since the circuit is opened by contacts 32 and 33. At the same time, stop 38 has switched toggle 34 to close contacts 35 and 36 to enable an exhalation assist.

Upon the receipt of an exhalation signal from sensor 20, latching driver 39 actuates solenoid valve 29 and the working fluid is free to pass from the interior of the housing 24. Working fluid 15*b* is flushed from the housing interior as biasing springs 26 once again urge piston 25 to the forward position. The forward motion of piston 25 forces fluid 14 into flexible bladder 12 and an exhalation assist is applied. When the piston arrives in the forward position as shown in FIG. 9, stop 30 opens contacts 35 and 36 to inhibit a greater exhalation assist so that even if an additional exhalation signal is received by latching driver 39 there will be no more of an exhalation assist provided.

It can be seen that the magnitude of the breathing assist provided is adjustable by the location of the stops on piston shaft 25*b*. If a greater collapse and distention of the flexible bladder 12 is desired, the stops need only be spaced further apart on the piston shaft. If a smaller degree of breathing assist is desired, the stops are placed closer.

The rate at which the breathing assist is applied also becomes critical. It should follow normal respiration. To that end, an inlet constrictor 40 and an outlet constrictor 41 control the flow rate and hence the rate at which the pressures are applied. Optionally, these are manually adjustable by the diver and can be no more than small valves capable of having the size of their orifaces change by a simple manipulation. Another way to vary the flow rate is to control the speed of pump 27. This is done most expeditiously by having manual adjustment 23 connected to the motor that drives pump 27.

It should be understood that the aforedescribed electro-mechanical configuration is for demonstration purposes only. There are a variety of hydraulic switching mechanisms that can be substituted to function as the stops and the toggle switches did above. Either way, the end result is the same, that is to provide respiratory assist which follows a diver's normal breathing patterns by the synchronized application of positive and negative pressures across the upper abdomen and lower rib cage to assist breathing.

Figure 10:
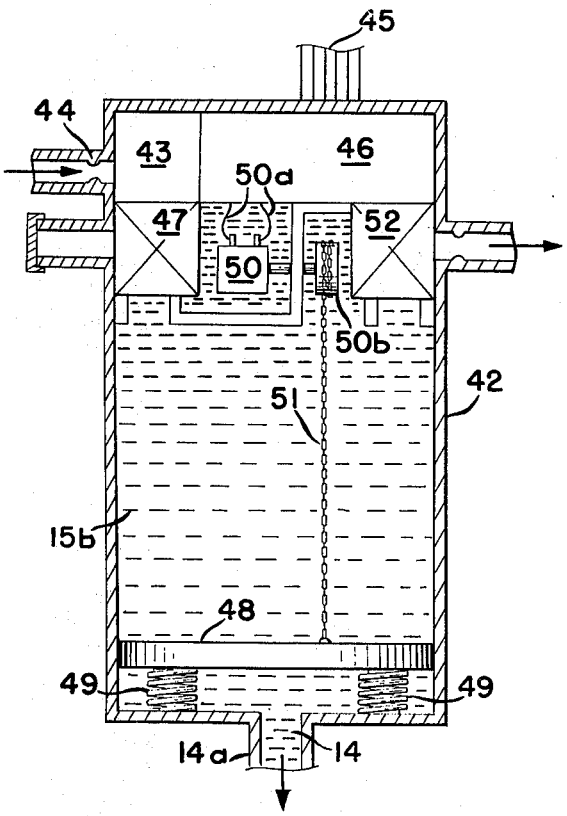

In the embodiment of FIG. 10, a reciprocating piston is employed to deliver the positive and negative pressures similar to the embodiment of FIG. 9. A cylindrically shaped housing 42 is configured to contain all of the elements of the control module and pump module. A pump 43 is disposed to draw in working fluid through constrictor 44 when the appropriate signals indicating that an exhalation assist is in order. These signals appear at the electrical inputs 45 which are coupled to a sensor 20, not shown.

Upon receipt of exhalation signals a black box of electronics 46 actuates motor 43 and opens the motor's associated solenoid valve 47. Working fluid is pumped into the housing and piston 48 is forced to overcome the biasing force of the pair of biasing springs 49. The displacement of the piston forces fluid 14 into the flexible bladder of the cuirasse and an assist to exhalation is provided.

A clock spring return position sensor 50 is coupled to the piston by a chain 51. The position sensor is biased by a clock-like spring and allows the playing out of the chain from its drum 50*b*. When a predetermined maximum length of chain is unreeled the position sensor is preset to deliver an exhalation inhibition signal across its lead 50*a*. When a predetermined minimum length of chain is retrieved by the position sensor, it is preset to deliver an inhalation inhibition signal across its leads 50*a*.

As working fluid continues to be pumped into the housing, piston 48 is displaced until the predetermined length of chain is unreeled. The exhalation inhibition signal is received by electronics 46 and pump 43 is turned off and solenoid valve 47 is closed.

Upon a receipt of an inhalation signal on the electrical inputs 45, electronics 46 will open solenoid valve 52. Biasing springs 49 urge piston 48 to its rearward position as fluid passes through constrictor 53. After the predetermined minimum length of chain 51 remains to be coiled on the return position sensor's drum 50*b*, sensor 50 initiates the inhalation inhibition signal and feeds it to electronics 46. Consequently, electronics 46 closes solenoid valve 52 at a rearward position which marks the position of a maximum inhalation assist.

Figure 11:
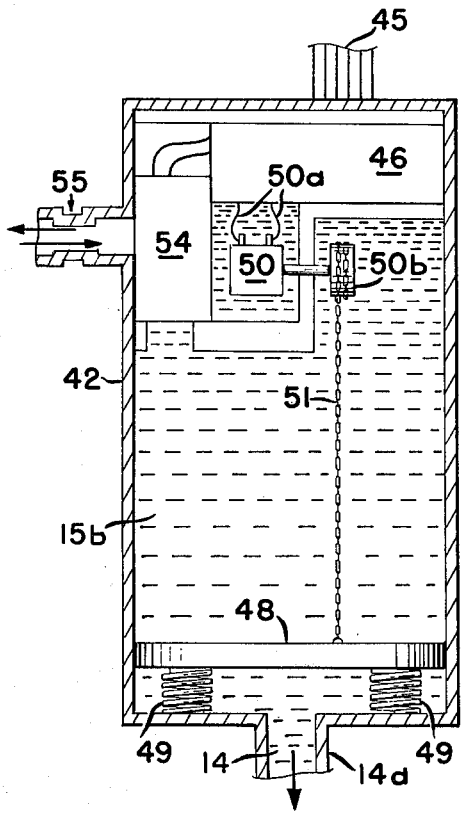

The embodiment of FIG. 11 is quite similar to that of FIG. 10 and like reference characters have been used to designate like elements. The main difference here is that a bidirectional pump 54 has been substituted in place of the one way pump 43 and the solenoid valves 47 and 52 of the embodiment of FIG. 10. Additionally, only a single adjustable constrictor 55 is needed to regulate the rate at which fluid is pumped into and out of the housing.

In both the embodiments of FIGS. 10 and 11 the lengths at which chain 51 is extended from 50*b* determine the maximum forward and minimum rearward positions of the piston and hence the magnitude of the breathing assist. In either case, a completely reliable assist to breathing is exerted by the cuirasse upon the electronic's reception of inhalation signals and exhalation signals from a sensor. The rate at which the breathing assist is delivered is determined by the orifice of the constrictor as well as the speed of the bidirectional motor 54. The magnitude of the breathing assist is determined by the length of the chain played out of the drum. The frequency of the breathing assist is governed at all times by the diver as he provides representative signals to the electronics 46.

Figure 12:
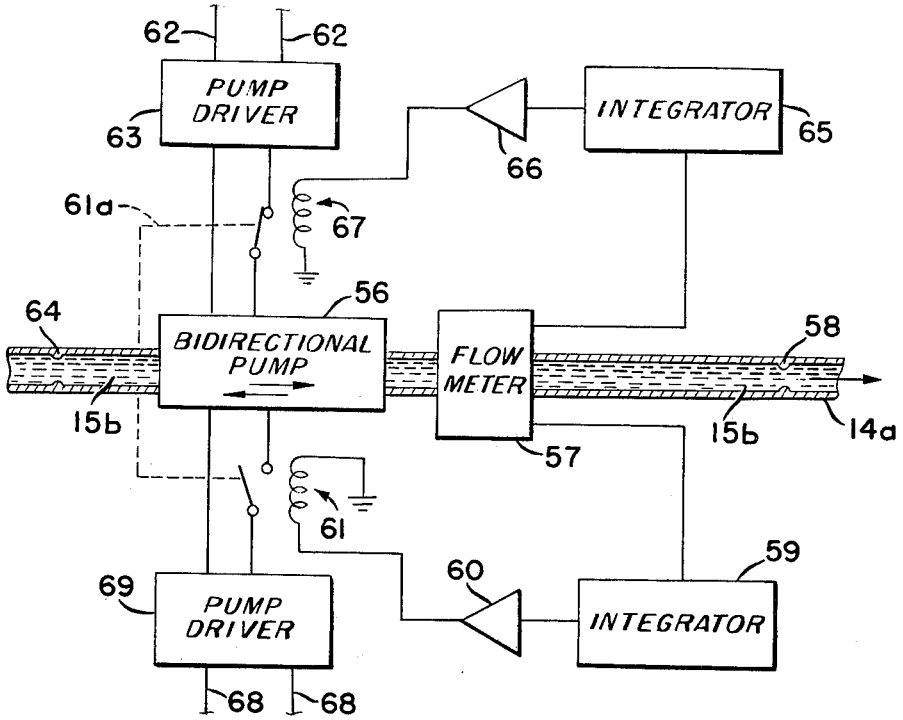

The embodiment of FIG. 12 shows yet another variation of a dual-module pump module for it is coupled directly to hose 14*a* and the cuirasse at its end where constrictor 58 is located. A bidirectional pump 56 impells or draws fluid through a flow meter 57. The flow meter is of the type conventionally marketed for providing a signal that is representative of the flow rate and, hence, the amount of fluid passing through it. The flow meter could be no more than a small paddle wheel arrangement coupled to a signal generator.

As a downstream constrictor 58 is regulating the flow of fluid to the cuirasse and hence controlling the rate of an exhalation assist, the generated signal representative of the flow rate is fed to an integrator 59. A voltage comparator 60 is responsive to a predetermined accumulated signal to generate a signal and pass it to a solenoid switch 61. The solenoid switch opens and the pump stops marking minimum exhalation pressure that is exerted by the cuirasse. Simultaneously, mechanical linkage 61*a* to another solenoid switch 67 closes its contacts to interconnect the pump to pump driver circuit 63.

An inhalation signal from a sensor, now shown, appears across leads 62 and actuates a pump diver circuit 63. The pump diver circuit reverses the pump and the flow of the fluid is drawn from the cuirasse, through constrictor 58 and out through constrictor 64.

Now flow meter 57 generates a signal indicating the evacuation of the cuirasse and passes this signal to integrator 65. After a predetermined charge has accumulated in voltage comparator circuit 66 a signal is fed to solenoid switch 67. Its contacts open and pump diver 63 is taken out of the circuit, thus marking the end of the inhalation assist. At the same time linkage 61*a* closes the contacts of solenoid switch 61 enabling pump driver circuit 69 and readying the apparatus for an exhalation assist.

Upon the receipt of an exhalation signal across leads 68 from the sensor, pump diver circuit 69 reverses bidirectional pump 56, 57 to start filling the cuirasse with fluid once again.

In this embodiment, the flow rate and hence, rate of the breathing assist, is determined by the setting of the adjustable constrictors and by a controlling of the speed of the pump. The magnitude of the breathing assist and the creation of positive or negative pressures by the cuirasse is determined by the magnitude preset in the two voltage comparators 60 and 66. Linkage 61*a* ensures that an exhalation assist is inhibited during the inhalation cycle and inhalation assist is inhibited during the exhalation cycle.

Figure 13:
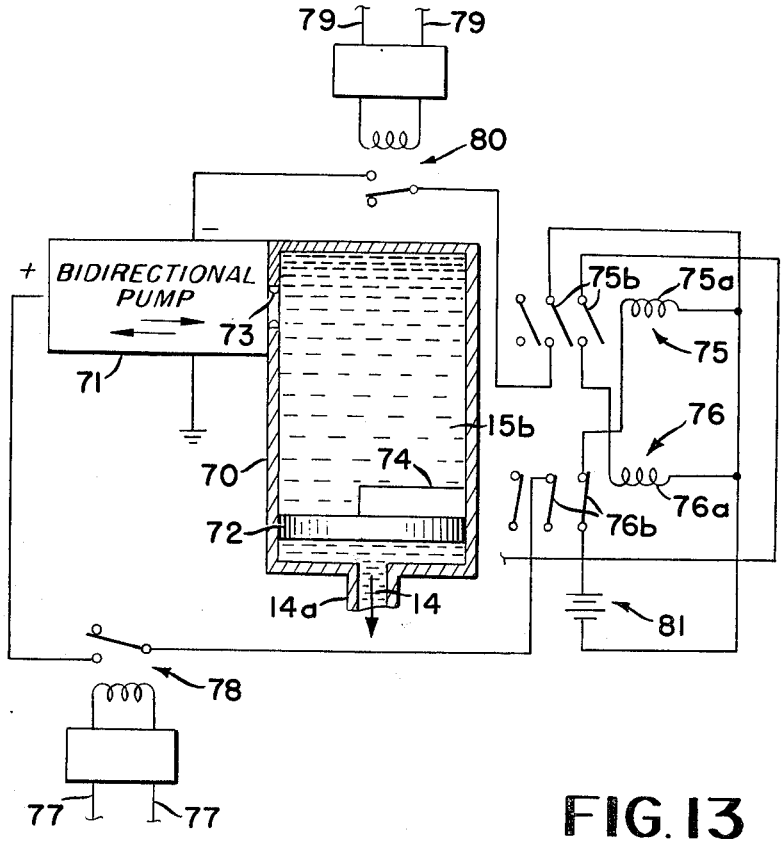

In the embodiment of FIG. 13 the cylindrically shaped housing 70 is filled and evacuated by a bidirectional pump 71. The bidirectional excursions of the piston 72 cause the flow of fluid to and from the cuirasse via hose 14*a* and result in the creation of positive and negative assists.

A single constrictor 73 or the speed of the pump regulates the rate of the breathing assist. A magnet 74 mounted on the piston and a pair of latching reed relays 75 and 76 limit the magnitude of the assist.

With the piston 72 in the forward assist position as shown in FIG. 13 the maximum exhalation assist pressure is exerted by the flexible bladder in the cuirasse. Latching reed relay 76 is closed and coil 75*a* is energized holding contacts 75*b* open. An inhalation signal across leads 77 causes a solenoid switch 78 to close. Pump 71 is actuated to evacuate cylindrically shaped housing 70 and draw fluid from the cuirasse as piston 72 travels toward the rearward position.

Evacuation of the cylinder continues until magnet 74 reaches a rearward position in alignment with latching reed relay 75. The proximity of the magnet closes contact 75*b* which energize the coil 76*a* of latching reed relay 76. Contacts 76*b* are opened and since there is absence of an inhalation signal, contacts of solenoid switch 78 are open to disable the circuit and mark the limits of the inhalation assist.

However, because contacts 75*b* of the latching reed relay 75 are closed, exhalation is enabled. Upon the receipt of an exhalation signal across leads 79, a reverse potential from potential source 81 is applied to the pump and the pump commences to fill the cylinder with fluid. Piston 72 is displaced toward its forward position fluid passes through the hose 14*a* to fill the flexible bladder in the cuirasse to the extent determined by the location of relay 76.

In this embodiment the magnitude of the potential source 81 optionally is used to adjust the rate at which positive and negative assist breathing pressures are fed to the cuirasse. A constrictor 73 optionally is used to establish flow rate. The magnitude of the breathing assist is established by the separation of the two reed relays.

Obviously, many modifications and variations are possible in the light of the above teachings, and, it is therefore understood that the invention may be practiced otherwise than as specifically described.

What is claimed is:

1. In an underwater breathing system adapted to be carried by a diver including means for delivering a dense gas mixture from said underwater breathing system to the diver, the improvement comprising:

means for assisting the breathing of said dense gas mixture said assisting means including means for fitting over the upper abdomen and lower rib cage;

means positioned in the dense gas mixture flow of the diver's underwater breathing system for sensing normal inhalation and exhalation to provide representative signals thereof;

means for fluidly coupling the fitting means to a source of fluid; and means responsive to said signals generated by said sensing means for pumping said source of fluid into the fitting means to create a positive pressure therein when said sensing means transmits an exhalation signal representative of normal exhalation and for pumping fluid out of the fitting means to create a negative pressure therein when the sensing means transmits an inhalation signal representative of normal inhalation thereby aiding in the breathing of the dense gas mixture.

2. An apparatus according to claim 1 in which the fitting means is a cuirasse shaped to fit over the upper abdomen and lower rib cage which includes, a semirigid outer shell having an arc shaped cross-sectional configuration and a flexible bladder carried inside the semirigid outer shell being connected to the pumping means by the fluidly coupling means.

3. An apparatus according to claim 2 further including:

means carried by the diver for controlling the magnitude and rate of fluid transfer by the pumping means to accommodate increased and decreased breathing demands.

4. An apparatus according to claim 3 in which the pumping means includes, a control module carried by the diver and coupled to the sensing means, and a pump module carried by the diver and coupled to the control module andd to the flexible bladder.

5. An apparatus according to claim 4 in which the control module includes first and second means for ensuring the creation of said negative pressure upon the receipt of an inhalation signal and said positive pressure upon the receipt of an exhalation signal to the degree and rate preset by the controlling means.

6. An apparatus according to claim 5 in which the first and second ensuring means include a first and second means for inhibiting the creation of said negative pressure while the pump module is in the process of creating said positive pressure and for inhibiting the creation of said positive pressure while the pump module is in the process of creating said negative pressure.

7. An apparatus according to claim 6 in which the pump module includes a motor driven pump coupled to feed pressurized fluid to a cylinder containing a piston capable of reciprocal displacement.

8. An apparatus according to claim 6 in which the pump module includes a bidirectional pump coupled to feed pressurized fluid to and from the flexible bladder.

9. An apparatus according to claim 8 in which the control module includes a first and a second means for providing a first signal and a second signal when said negative pressure and positive pressure reach a predetermined magnitude, the first and second signals are transmitted to stop the bidirectional pump.

10. An apparatus according to claim 9 in which the control means further includes a flow meter interposed between the bidirectional pump and the flexible bladder to provide generated signals to the first and second providing means to enable their production of the first and second signals.

11. An apparatus according to claim 10 in which the first and second providing means are two pairs of integrator voltage comparator combinations.

12. An apparatus according to claim 11 in which the voltage comparators have variable thresholds to allow for the variation of the magnitude of the breathing assist.

13. An apparatus according to claim 12 in which the controlling means includes at least one constrictor mounted adjacent the flow meter for controlling the flow rate of pressurized fluid to and from the bidirectional pump.

14. An apparatus according to claim 13 further including:

a reservoir of recyclable pressurized fluid connected to feed and receive fluid to the bidirectional pumps.

15. An apparatus according to claim 13 in which the pressurized fluid is water drawn in from and vented to the surroundings.

16. An apparatus for assisting the breathing of a diver carrying an underwater breathing system comprising:

a curirasse shaped to fit over the upper abdomen and lower rib cage which includes, a semirigid outer shell having an arc-shaped crosssectional configuration and a flexible bladder carried inside the semirigid shell; means adapted to the positioned in the diver's underwater breathing system for sensing normal inhalation and exhalation to provide representative signals thereof;

means for fluidly coupling the flexible bladder to a source of fluid;

means responsive to said signals generated by said sensing means for pumping said source of fluid into the cuirasse to create a positive pressure therein when the sensing means transmits an exhalation signal representative of normal exhalation and for pumping fluid out of the cuirasse to create a negative pressure therein when the sensing means transmits an inhalation signal representative of normal inhalation, the pumping means includes, a control module coupled to the sensing means having first and second means for ensuring the creation of said negative pressure upon the receipt of an inhalation signal and said positive pressure upon the receipt of an exhalation signal and a pump module coupled to the control module and to the flexible bladder, the first and second ensuring means include a first and a second means for inhibiting the creation of said negative pressure while the pump module is in the process of creating said negative pressure, the pump module includes a motor driven pump coupled to feed pressurized fluid to a cylinder containing a piston capable of recriprocal displacement, the piston is provided with means for mechanically engaging the first and second ensuring means at a forward position and at a rearward position of the displacement of the piston to mark the limits of the creation of said negative pressure and said positive pressure; and means for controlling the magnitude and rate of fluid transfer by the pumping means to accommodate increased and decreased breathing demands.

17. An apparatus according to claim 16 in which the motor driven pump impells a one way flow of pressurized fluid to the cylinder and the pump module further includes:

an inlet valve interposed between the motor driven pump and the cylinder and being electrically coupled to the first ensuring means to allow the flow of the pressurized fluid when the inhalation signal is received and an outlet valve connected to the cylinder and electrically coupled to the second ensuring means to allow the venting of pressurized fluid in the cylinder when the exhalation signal is received.

18. An apparatus according to claim 17 further including:

a spring biasing the piston to the rearward position where said negative pressure is fed to the flexible bladder, when the inlet valve is opened and pressurized fluid fills the cylinder, the biasing force of the spring is overcome and the piston moves to the forward position to feed said positive pressure to the flexible bladder, when the outlet valve is opened, the pressurized fluid in the cylinder is vented and the biasing force of the spring is sufficient to return the piston to its rearward position.

19. An apparatus according to claim 18 in which the controlling means includes a separate adjustable constrictor mounted adjacent the inlet valve and the outlet valve for controlling the flow rate of the pressurized fluid to and from the cylinder and the controlling means further includes a spring biased return position sensor having a chain connected to the piston to limit the displacement of the piston.

20. An apparatus according to claim 19 in which the motor driven pump, first ensuring means and second ensuring means are mounted inside the cylinder.

21. An apparatus according to claim 20 further including:

a reservoir of recyclable, pressurized fluid connected to feed pressurized fluid to the motor driven pump and to receive pressurized fluid from the outlet valve.

22. An apparatus according to claim 20 in which the pressurized fluid is water drawn in from and vented to the surroundings.

23. An apparatus according to claim 20 in which the sensing means is a suitably connected humidity sensor located in the face mask.

24. An apparatus according to claim 20 in which the sensing means is a suitably connected pressure differential sensor located in the face mask.

25. An apparatus according to claim 20 in which the sensing means is a suitably connected temperature sensor located in the face mask.

26. An apparatus according to claim 17 further including:

a spring biasing the piston to the forward position where said positive pressure is fed to the flexible bladder, when the inlet valve is opened and pressurized fluid fills the cylinder, the biasing force of the spring is overcome and the piston moves to the rearward position to feed said negative pressure to the flexible bladder, when the outlet valve is opened, the pressurized fluid in the cylinder is vented and the biasing force of the spring is sufficient to return the piston to its forward position.

27. An apparatus according to claim 26 in which the controlling means includes a separate adjustable constrictor mounted adjacent the inlet valve and the outlet valve for controlling the flow rate of the pressurized fluid to and from the cylinder and the mechanical engaging means limits the magnitude of the displacement of the piston.

28. An apparatus according to claim 27 further including:

a reservoir of recyclable, pressurized fluid connected to feed pressurized fluid to the motor driven pump and to receive pressurized fluid from the outlet valve.

29. An apparatus according to claim 27 in which the pressurized fluid is water drawn in from and vented to the surroundings.

30. An apparatus according to claim 27 in which the sensing means is a suitably connected humidity sensor located in the face mask.

31. An apparatus according to claim 27 in which the sensing means is a suitably connected pressure differential sensor located in the face mask.

32. An apparatus according to claim 27 in which the sensing means is a suitably connected temperature sensor located in the face mask.

33. An apparatus according to claim 16 in which the motor driven pump impells a bidirectional flow of pressurized fluid to the cylinder when the first ensuring means transmits the inhalation signal and from the cylinder when the second ensuring means transmits the exhalation signal.

34. An apparatus according to claim 33 further including:

a spring biasing the piston to the rearward position where said negative pressure is fed to the flexible bladder, when the bidirectional pump impells pressurized fluid into the cylinder, the biasing force of the spring is overcome and the piston moves to the forward position to feed said positive pressure to the flexible bladder, when the bidirectional pump reverses the direction of flow, pressurized fluid is evacuated from the cylinder and the biasing force of the spring is sufficient to return the piston to its rearward position.

35. An apparatus according to claim 34 in which the controlling means includes a separate adjustable constrictor mounted on the bidirectional pump for controlling the flow rate of the pressurized fluid to and from the cylinder and the controlling means further includes a spring biased return position sensor having a chain connected to the piston to limit the magnitude of displacement of the piston.

36. An apparatus according to claim 35 further including:

a reservoir of recyclable, pressurized fluid connected to feed pressurized fluid to the motor driven pump and to receive pressurized fluid from the outlet valve.

37. An apparatus according to claim 36 in which the pressurized fluid is water drawn in from and vented to the surroundings.

38. An apparatus according to claim 36 in which the sensing means is a suitably connected humidity sensor located in the face mask.

39. An apparatus according to claim 36 in which the sensing means is a suitably connected pressure differential sensor located in the face mask.

40. An apparatus according to claim 36 in which the sensing means is a suitably connected temperature sensor located in the face mask.

41. An apparatus for assisting the breathing of a diver carrying an underwater breathing system comprising:

a curirasse shaped to fit over the upper abdomen and lower rib cage which includes, a semirigid outer shell having an arc-shaped cross-sectional configuration and a flexible bladder carried inside the semirigid outer shell;

means adapted to be positioned in the diver's underwater breathing system for sensing normal inhalation and exhalation to provide representative signals thereof;

means for fluidly coupling the flexible bladder to a source of fluid;

means responsive to signals generated by said sensing means for pumping said source of fluid into the cuirasse to create a positive pressure therein when the sensing means transmits an exhalation signal representative of normal exhalation and for pumping fluid out of the cuirasse to create a negative pressure therein when the sensing means transmits an inhalation signal representative of normal inhalation, the pumping means includes, a control module coupled to the sensing means having first and second means for ensuring the creation of said negative pressure upon the receipt of an inhalation signal and said positive pressure upon the receipt of an exhalation signal and a pump module coupled to the control module and to the flexible bladder, the first and second ensuring means includes a first and a second means for inhibiting the creation of said negative pressure while the pump module is in the process of creating said positive pressure and for inhibiting the creation of said positive pressure while the pump module is in the process of creating said negative pressure, the pump module includes a motor driven pump coupled to feed pressurized fluid to a cylinder containing a piston capable of reciprocal displacement, the piston is provided with a means for magnetically engaging the first and second ensuring means at a forward position and at a rearward position of the displacement of the piston to mark the limits of the creation of said negative pressure and said positive pressure; and means for controlling the magnitude and rate of fluid transfer by the pumping means to accommodate increased and decreased breathing demands.

42. An apparatus according to claim 41 in which the motor driven pump impells a bidirectional flow of pressurized fluid to the cylinder when the first ensuring means transmits the inhalation signal and from the cylinder when the second ensuring means transmits the exhalation signal.

43. An apparatus according to claim 42 in which the controlling means includes a separate adjustable constrictor mounted on the bidirectional pump for controlling the flow rate of the pressurized fluid to and from the cylinder and the controlling means further includes a pair of latching reed relays positioned to limit the magnitude of displacement of the piston.

44. An apparatus according to claim 43 further including:

a reservoir of recyclable pressurized fluid connected to feed pressurized fluid to the motor driven pump and to receive pressurized fluid from the outlet valve.

45. An apparatus according to claim 43 in which the pressurized fluid is water drawn in from and vented to the surroundings.

46. An apparatus according to claim 43 in which the sensing means is a suitably connected humidity sensor located in the face mask.

47. An apparatus according to claim 43 in which the sensing means is a suitably connected pressure differential sensor located in the face mask.

48. An apparatus according to claim 43 in which the sensing means is a suitably connected temperature sensor located in the face mask.

* * * * *